US008171864B2

(12) United States Patent
Mucio

(10) Patent No.: US 8,171,864 B2
(45) Date of Patent: May 8, 2012

(54) SECURITY, MONITORING AND CONTROL SYSTEM FOR PREVENTING UNAUTHORIZED ENTRY INTO A BANK OR OTHER BUILDING

(75) Inventor: Matt Mucio, Pleasanton, CA (US)

(73) Assignee: 1st United Services Credit Union, Pleasanton, CA (US)

( * ) Notice: Subject to any disclaimer, the term of this patent is extended or adjusted under 35 U.S.C. 154(b) by 233 days.

(21) Appl. No.: 12/638,594

(22) Filed: Dec. 15, 2009

(65) Prior Publication Data

US 2010/0147201 A1 Jun. 17, 2010

Related U.S. Application Data

(60) Provisional application No. 61/138,415, filed on Dec. 17, 2008.

(51) Int. Cl.
*E05G 5/00* (2006.01)

(52) U.S. Cl. ..... 109/6; 109/3; 109/7; 109/8

(58) Field of Classification Search ..... 109/3, 6–8
See application file for complete search history.

(56) References Cited

U.S. PATENT DOCUMENTS 4,060,039 A * 11/1977 Lagarrigue ..... 109/3
4,308,803 A * 1/1982 Pretini ..... 109/3
4,341,165 A * 7/1982 Calandritti et al. ..... 109/8
4,385,469 A * 5/1983 Scheuerpflug et al. ..... 49/41
4,461,221 A * 7/1984 Schandle et al. ..... 109/6
4,481,887 A * 11/1984 Urbano ..... 109/3
4,534,131 A * 8/1985 Blackston et al. ..... 49/42
4,586,441 A * 5/1986 Zekich ..... 109/8
4,656,954 A * 4/1987 Tonali ..... 109/6
4,741,275 A * 5/1988 Lewiner et al. ..... 109/7
5,195,448 A * 3/1993 Sims ..... 109/6
5,311,166 A * 5/1994 Frye ..... 340/541
5,542,211 A * 8/1996 Colombo ..... 49/42
5,552,766 A * 9/1996 Lee et al. ..... 340/541
5,615,622 A * 4/1997 Moses et al. ..... 109/2
5,692,446 A * 12/1997 Becker et al. ..... 109/3
5,769,011 A * 6/1998 Daniel ..... 109/7
5,878,529 A * 3/1999 Huber ..... 49/68
6,298,603 B1 * 10/2001 Diaz ..... 49/68
6,308,644 B1 * 10/2001 Diaz ..... 109/6
7,023,339 B2 * 4/2006 Stomski ..... 340/540
7,119,682 B1 * 10/2006 Fisher ..... 340/550
7,707,951 B1 * 5/2010 Prasad ..... 109/30
2005/0093697 A1 5/2005 Nichani et al.
2005/0249382 A1 11/2005 Schwab
2006/0150872 A1 * 7/2006 Mesinger ..... 109/8
2008/0121682 A1 5/2008 Grim et al.

* cited by examiner

*Primary Examiner* — Suzanne Barrett
(74) *Attorney, Agent, or Firm* — Steven A. Nielsen; Allman & Nielsen, P.C.; NielsenPatents.com

(57) ABSTRACT

A series of doors, locks, walls and signage present a vestibule room or safety enclosure for use in controlling access into a secured space. Exterior signage regarding weapon detection equipment and the appearance of a mantrap enclosure is used to dissuade visitors from bringing weapons into the secured area. A person within the safety enclosure may always exit through the exterior door and thus avoid harm in the event of a natural disaster.

2 Claims, 6 Drawing Sheets

SECURITY, MONITORING AND CONTROL SYSTEM FOR PREVENTING UNAUTHORIZED ENTRY INTO A BANK OR OTHER BUILDING

CROSS-REFERENCE TO RELATED APPLICATIONS

This is a utility application based upon U.S. patent application Ser. No. 61/138,415, entitled "Security, monitoring and control system for preventing unauthorized entry into a bank or other building," filed on Dec. 17, 2008. This related application is incorporated herein by reference and made a part of this application. If any conflict arises between the disclosure of the invention in this utility application and that in the related provisional application, the disclosure in this utility application shall govern. Moreover, the inventor(s) incorporate herein by reference any and all patents, patent applications, and other documents hard copy or electronic, cited or referred to in this application.

BACKGROUND OF THE INVENTION (1) Field of the Invention

The invention generally relates to indoor security and monitoring systems. More particularly, the invention relates to a new and novel system and method of providing a secure vestibule to screen unknown visitors before allowing access into a screened visitor area.

(2) Description of the Related Art

Several attempts to provide methods of screening visitors or detaining dangerous visitors are known in the art. For example, U.S. patent application publication 2005/0249382 A1 to Schwab et al discloses a mantrap with a primary zone and a secondary zone. Unfortunately, the Schwab system requires a great deal of space to accommodate two separate zones, each large enough to secure a person. Moreover, the Schwab system is prone to liability issues as a person trapped within the system may later allege false imprisonment or suffer injury in the event of an earthquake or fire.

U.S. patent application publication U.S. 2008/0121682 assigned to IBM provides a mantrap system for the secure delivery of packages, but requires each person entering the system to have preissued identification and a prearranged appointment. Unfortunately, the IBM system is not well suited for use in a bank or other business where the preissuance of identification is not practical.

U.S. patent application publication U.S. 2005/0093697 by Nichani et al discloses a large turn stall system using complex 3D imaging systems. Unfortunately, current 3D technology is not practical for accurate real time display systems. Also, the four quadrant turn stall system consumes an inordinate amount of interior space.

Thus, there is a need in the art for a compact system to screen unknown visitors within the confines of a typical interior entry room or vestibule.

BRIEF SUMMARY OF THE INVENTION

The present invention overcomes shortfalls in the related art by presenting an unobvious and unique combination and configuration of a monitoring system, screening protocol, secure filtering room and other components.

Unlike the related art, the present invention is compact, economical to install and operate and avoids liability for trapping visitors.

There is a need for the present invention as banks, jewelry stores, music stores and other businesses are now, more than ever, susceptible to robbery, forced entry and other unlawful activity often perpetrated by unknown visitors entering through a public entrance. The present invention presents a physical barrier, control system, and employee protocol designed to reduce the likelihood of an unwelcomed visitor entering a protected premises.

Safety Enclosure or Control Room

In one embodiment, a control room or safety enclosure is presented. The safety enclosure comprises one interior area only. The use of a turn stall or multiple enclosure compartments is not contemplated as such configurations are not well suited for relatively small buildings or business structures. The safety enclosure has one exterior door and one interior door only. Both doors have means of locking that may be controlled by special purpose computer, but an operator of the disclosed system may always override locking or unlocking signals generated by the special purpose computer.

In one embodiment, the safety enclosure is positioned just inside an interior/exterior boundary of a protected business. The exterior door of the system separates the interior and exterior boundary. The floor plan of the safety enclosure may be square in shape and have dimensions greater than six feet by six feet, so as to accommodate potential visitors in wheel chairs and to make the safety enclosure compliant with the Americans with Disabilities Act ("ADA").

The safety enclosure may contain sensors to detect metallic mass. The readings from the sensors may be displayed by monitors mounted to a location visible to an operator of the system. In one configuration, the monitors are mounted near the safety enclosure such that a bank teller or operator may view the monitors as well as the person within the safety enclosure.

The interior door of the safety enclosure may be located within an interior wall adjacent to the wall of the exterior door. The interior door of the safety enclosure separates the interior compartment of the safety enclosure and the interior of the protected business.

Control System

An advantage of the disclosed control system and disclosed operator protocol is that a typical visitor or potential visitor cannot ascertain the risk of being trapped within the safety enclosure. A typical member of the public will see a secured safety enclosure secured by two locking doors, one exterior and one interior, the latter leading into the protected business. During business hours, a typical potential visitor is presented with an unlocked exterior door and signage instructing the potential visitor(s) to enter one at a time. Upon entering the safety chamber from the exterior, the exterior door locks for a specific operator preprogrammed amount of time. At this juncture, the potential visitor experiences an exterior door locked from the outside, the interior of the safety enclosure and a locked interior door between the safety enclosure and the interior business. Thus, the typical visitor assumes that upon entry into the safety enclosure the visitor will be trapped between two locked doors. But, unbeknownst to the visitor, the exterior door may always be opened from the inside of the safety enclosure by means of a moveable handle or other hardware. As the exterior door is locked from the outside, other potential visitors may not join the person in the safety chamber. Unexpected results have been achieved by use of the system, in that there have been no known security problems to have occurred when using the disclosed system.

Upon entry into the safety enclosure the exterior door closes and makes a latching sound. The exterior door then goes into a locked state for a predetermined amount of time, typically ten seconds. The potential visitor is then electronically scanned. In one embodiment, the magnetic distortion within the safety chamber is measured so as to indicate the amount of metallic mass presented by the potential visitor. The use of x-rays or other intrusive means of inspection are not desirable due to the danger of disrupting medical devices used by the potential visitor. Part of the disclosed protocol requires an operator of the system to visually inspect the potential visitor and to make a decision as to whether to allow the potential visitor access into the secured space. Video cameras transmit real time pictures of the potential visitor to monitors visible to the operator. Upon approval by the system operator, the potential visitor is allowed into the secured space by entry through the interior door.

While in the safety enclosure, the potential visitor may be questioned by the operator using a wireless two way intercommunication device and the potential visitor can be further observed. To assist the operator in discerning the potential danger of the potential visitor, a metallic reading or magnetic distortion value may be displayed upon the video monitors described above.

During the visitor inspection process, the potential visitor is within the safety enclosure and both doors are closed. The interior door is locked from use from inside the safety enclosure and the exterior door is locked from use from outside of the building. While the potential visitor within the safety enclosure, the exterior door is always operable from the inside the safety enclosure. Unlike the related art, no attempt is made to trap a potential visitor within the chamber. In the event of a fire or electrical emergency, a potential visitor is at liberty to leave the premises through the exterior door.

To further decrease the likelihood of a tragedy in the event of a fire or electrical problem, both doors may be opened by use of movable handles at all times. From within the safety enclosure, a moveable handle upon the exterior door is presented. From within the secured building space, a moveable handle upon the interior door is presented. The moveable handles will open a door even if the door is in a locked state. The disclosed system always allows people to exit the building even if there is an electrical problem that places the doors into a locked state.

The Piggy Back Problem

In a typical takeover robbery, multiple assailants will attempt to gain access into a building or business. The present invention addresses this problem with a door locking protocol and control system.

Upon entry by a potential visitor into the safety enclosure, the interior door is locked from inside the safety enclosure and the exterior door is inoperable by persons outside of the building for a specific preprogrammed amount of time. In the event that two or more persons have entered the safety enclosure, an operator of the system simply refuses to release the lock that secures the interior door and occupants inside the safety enclosure are told via the wireless two way intercommunication device to vacate the safety enclosure and to enter one at a time.

These and other objects and advantages will be made apparent when considering the following detailed specification when taken in conjunction with the drawings.

REFERENCE NUMERALS IN THE DRAWINGS

Figure 1:
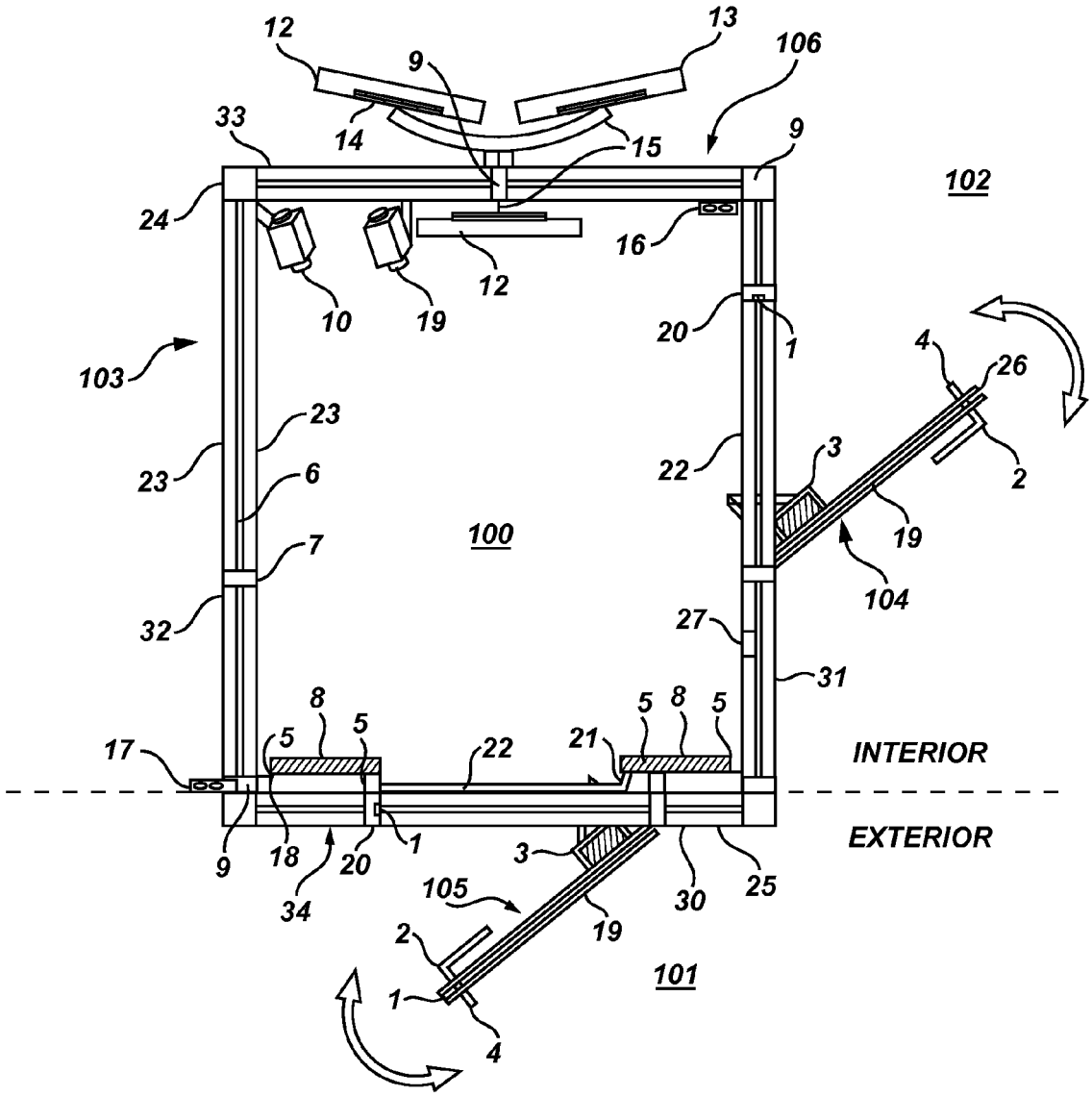
FIG. 1 is a top plan view of the safety enclosure with both doors in an open position.

1 electrified door strike
2 movable door handle
3 door closer
4 fixed door handle
5 L shaped scanner brackets
6 glass panel, may be one inch or greater
7 vertical mullion, may be two inches
8 scanners
9 wire entry point
10 video camera
11 scanner camera
12 video monitor
13 scanner monitor
14 monitor mount
15 monitor mount base
16 power outlets
17 power outlets for monitor
18 power outlets for scanners
19 glass or other transparent material
20 LED signal light
21 scanner connecting ribbon
22 overhead pane
23 horizontal mullion (may be two inches)
24 vertical corner mullion (may be four inches)
25 weapons detector signage
26 door mortise
27 two way wireless intercommunication device, may comprise a communication system with a microphone located within the safety chamber.
28 open void area at top section of the first interior wall 31
29 open void area at top section of the third interior
30 exterior wall containing the exterior door 105
31 first interior wall containing the interior door 104
32 second interior wall opposite to the first interior wall 31
33 third interior wall opposite of the exterior wall 30
34 exterior side of exterior wall 30
100 interior space within safety chamber
101 exterior area of safety chamber
102 interior of protected business, protected business interior space or protected interior space
103 safety chamber or the disclosed invention in general
104 interior door
105 exterior door
106 teller side of the safety chamber or wall of the safety chamber that faces the teller or operator of the system

DETAILED DESCRIPTION OF EMBODIMENTS OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout.

Unless otherwise noted in this specification or in the claims, all of the terms used in the specification and the claims will have the meanings normally ascribed to these terms by workers in the art.

Unless the context clearly requires otherwise, throughout the description and the claims, the words "comprise," "comprising" and the like are to be construed in an inclusive sense as opposed to an exclusive or exhaustive sense; that is to say, in a sense of "including, but not limited to." Words using the singular or plural number also include the plural or singular number, respectively. Additionally, the words "herein," "above," "below," and words of similar import, when used in this application, shall refer to this application as a whole and not to any particular portions of this application.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize. For example, while steps are presented in a given order, alternative embodiments may perform routines having steps in a different order. The teachings of the invention provided herein can be applied to other systems, not only the systems described herein. The various embodiments described herein can be combined to provide further embodiments. These and other changes can be made to the invention in light of the detailed description.

All the above references and U.S. patents and applications are incorporated herein by reference. Aspects of the invention can be modified, if necessary, to employ the systems, functions and concepts of the various patents and applications described above to provide yet further embodiments of the invention.

Referring to FIG. 1, the disclosed security and access control system is sometimes referred to as SecurePoint and is shown generally as 103. The invention may be considered to comprise an interior space within a larger space or interior of a protected business 102.

In the preferred embodiment, the interior space 100 within the disclosed safety chamber 103 is compliant with the Americans with Disabilities Act (ADA). The interior space 100 may be sized six feet by six feet.

Unexpected results are achieved in the preferred embodiment by the disclosed configuration of the interior door 104 positioned at 90 degrees and adjacent to the exterior door 105. The disclosed configuration allows for clear viewing through the teller side 106 of the chamber as well as the use of extra heavy bullet and explosive resistant material within the teller side 106 of the chamber. In some circumstances, the use of extra heavy material within the interior door 104 is not practical. The disclosed configuration of the interior door 104 also provides the unexpected result of fewer distractions to customers waiting in line and the position of the door naturally directs customers to the rear of a waiting line.

Further unexpected results are achieved by use of the disclosed relay system that controls the electric door strikes of the exterior door 105 and interior door 104. The disclosed relay system prevents unwanted visitors from entering the interior 102 of the protected business while simultaneously protecting all potential visitors from being trapped within the interior 100 of the safety chamber 103. By use of electrified door strikes 1 for both the interior 104 and exterior 105 doors, in the event of a power outage, a potential visitor as well as all visitors within the interior 102 of the protected business are able to exit through the disclosed safety chamber 103.

An unexpected illusion of presenting a mantrap is achieved by use of the disclosed LED signal light 20, weapons detector signage 25 and heavy duty glass door 19 presented at the exterior 101 area of the safety chamber. A typical potential visitor tempted to commit crimes within the interior 102 area of the protected business has no way of knowing that the exterior door 105 is never locked from the inside 100 of the chamber. To the contrary, the disclosed invention has every appearance of being a mantrap wherein a potential visitor runs the risk of being trapped within the interior 100 area of the safety chamber 103. The use of visible L shaped scanner brackets 5, scanners 8, scanner cameras 11, and other security equipment presents the illusion that the present invention has the capability to detain potential visitors within the interior 100 of the safety chamber. The mantrap illusion has achieved unexpected results in lowering the number of unwelcomed visitors entering the safety chamber. Users of the invention have avoided liability for false imprisonment by virtue of the non locking feature of the exterior door 105 from inside the safety chamber 100 and by virtue of non-locking feature of the interior door 104 from inside of the interior area 102 of the protected business.

The function and configuration of the disclosed relay switch system may be described by review of the protocol followed for a potential visitor. A potential visitor may enter the interior 100 of the safety enclosure but will be stopped from entering the inside of the business 102 by the interior door. Upon entering the security enclosure from the exterior, a potential visitor may be presented with an intercom and/or buzzer button to summon the attention of a system operator. The disclosed relay switch system will not allow an outside potential visitor from opening the exterior door while a potential visitor is within the interior 100 of the safety chamber. This feature of the relay system prevents the piggy back problem disused above. If and only if, the interior 100 of the safety chamber is empty, an operator may depower the electric door strike 1 and thus allow an outside potential visitor to enter the interior of the safety chamber. A door closer 3 gently closes the door behind the potential visitor who has entered the safety chamber. After the exterior door 105 is in a closed position, the exterior door may not be opened from the outside, as the electric door strike powers up after the door is closed up to a specific preprogrammed time by operator.

While the potential visitor is within the confines of the interior of the safety chamber, the potential visitor may use the movable door handle 2 of the exterior door to exit the chamber at any time. While within the safety chamber, the potential visitor may be electronically inspected by scanners sensitive to magnetic distortions presented by the potential visitor. The scanner may be located inches away from the interior edge of the exterior door. The reading of the scanner results is performed by the operators of the system. The measuring of magnetic distortions does not present a risk of interfering with medical devices used by the potential visitors and does not subject the operators of the system to liability for using intrusive means of inspection.

During the inspection process, a video camera 10 and scanner camera 11 may be used to view and/or inspect the potential visitor. The readings from the cameras may be projected by use of a scanner monitor 13 and video monitor 12 which may be mounted upon the wall 106 of the safety chamber that faces the teller or operator of the system. In FIG. 1, the monitor mount base 15 is shown supporting the two monitors 12 and 15. A wireless intercom 27 is presented within the safety chamber to allow a system operator to speak with a potential visitor. Before or during such a conversation, a system operator has the ability to view the video monitor 12 and/or scanner monitor 13 to assist in evaluating the intentions and/or danger of the potential visitor.

In the preferred embodiment, the scanner monitor 13 displays values or graphics in response to the magnetic distortion perceived by the scanner camera 13 or similar scanning device. An operator of the system, either through training or through experience will have in mind a threshold value or graphic to depict an unusually large magnetic distortion and/or a magnetic distortion of an usual shape in light of the characteristics of the potential visitor.

After a system operator is satisfied with the inspection of the potential visitor, the system operator may power down the door strike 1 to the interior door 104 and allow the potential visitor to become a visitor within the interior 102 of the protected business.

The interior door's movable handle is configured to safely allow a visitor within the protected business 102 to exit through the safety chamber. A visitor wishing to leave the protected business may use the movable door handle 2 located at the exterior side of the interior door 104, and then by use of the moveable door handle located upon the interior side of the external door.

Referring to FIG. 1 the exterior wall 30 secures the exterior door 105. The first interior wall 31 is positioned perpendicularly from the exterior wall 30. The first interior wall 30 secures the interior door 104. A second interior wall 32 is found adjacent to and perpendicular from the exterior wall 30. A third interior wall 33 is parallel to the exterior wall and perpendicularly attached to the first and second interior walls. Persons approaching the exterior side 34 of the exterior wall 30 will observe signage 25 warning of the presence of weapon detection instruments.

Figure 2:
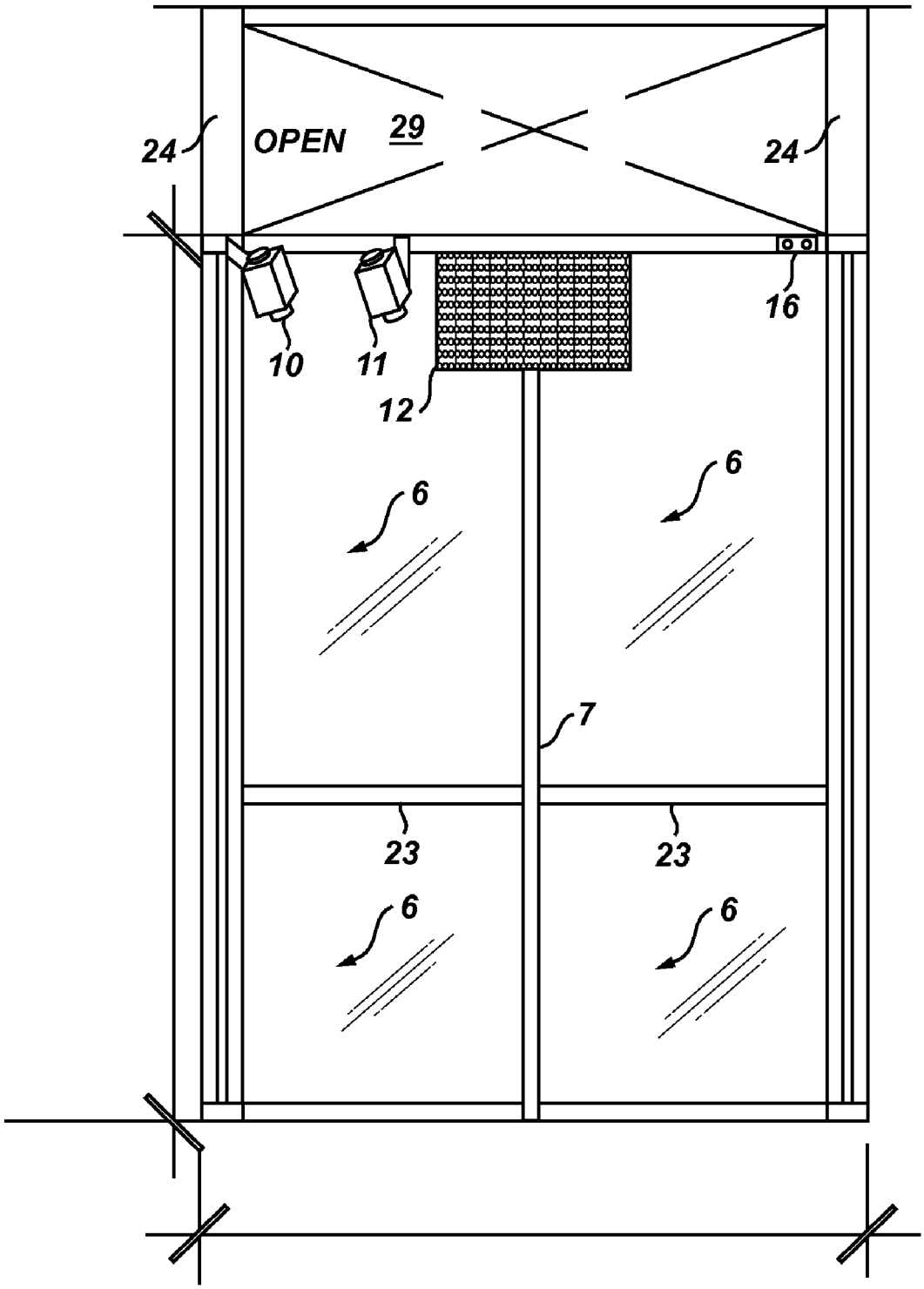
FIG. 2 is an interior elevation view an interior wall.

Referring to FIG. 2 an elevation view of an interior wall is presented. Starting from the top, two vertical corner mullions 24 attach to the ceiling and other walls. An open void 29 is found between the corner mullions 24. Power outlets 16 may be found just below the void section 29 and may power video cameras 10 and scanner cameras 11. The scanner cameras may have means of detecting magnetic distortions occurring within the safety chamber when metal introduced by a visitor standing within the safety chamber. A video monitor 12 may be present to display the occupant of the safety chamber or the extent of magnetic distortions found within the safety chamber. Glass panels 6 are supported by mullions 24 and one or more vertical mullions 7 and one or more horizontal mullions 23.

Figure 3:
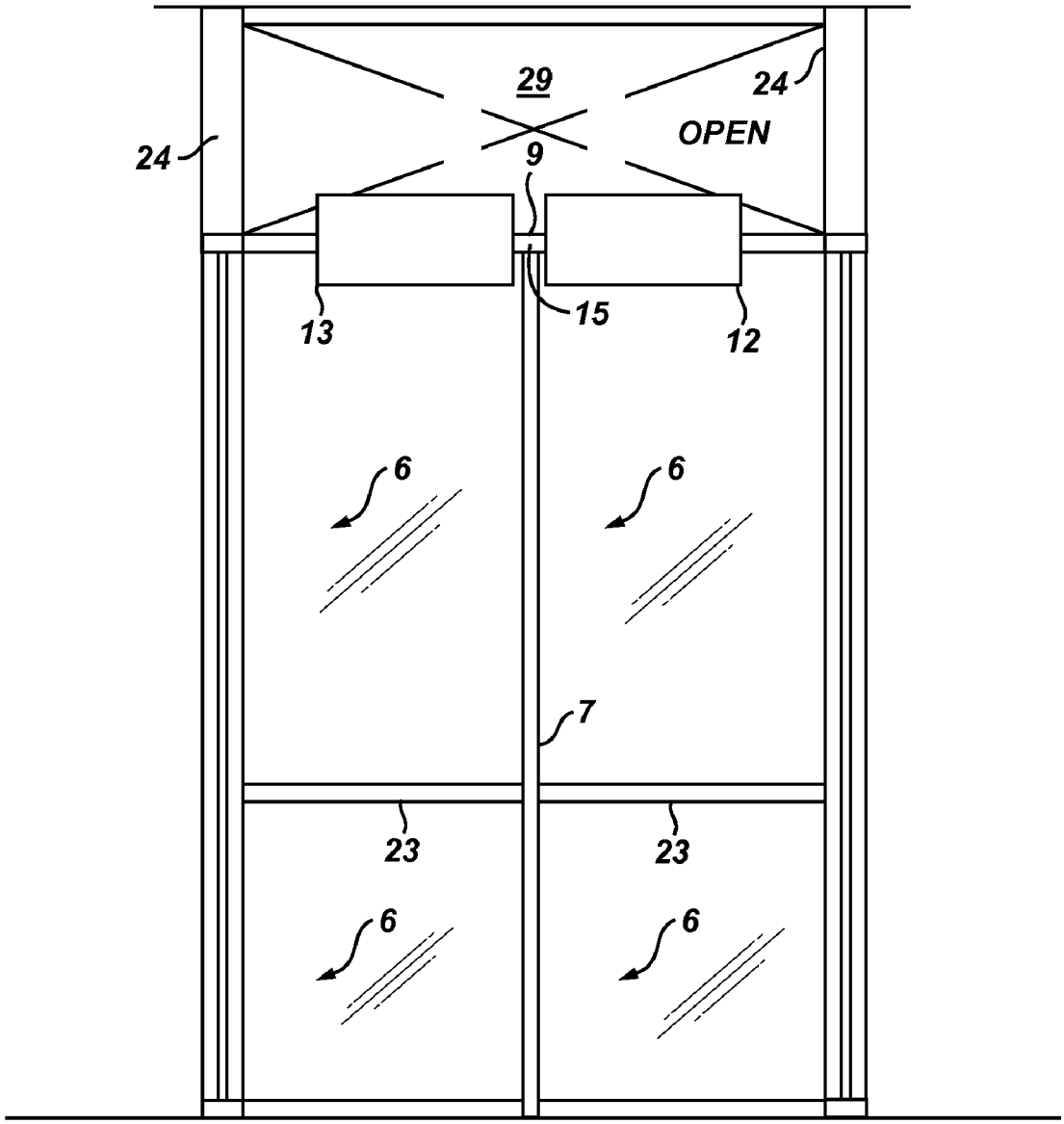
FIG. 3 is an exterior elevation view the third interior wall.

Referring to FIG. 3 an exterior elevation view of the third interior wall 33 is presented. A bank teller or operator of the system would see the presented view while positioned within the interior of the protected business 102 or protected interior space. Just below the top open space 29 a scanner monitor 13 and video monitor 12 face the protected interior section. A monitor mount base 15 and wire entry point 9 are found between the scanner monitor and video monitor. One or more glass panels 6 allow system personal to view the interior section 100 of the safety chamber.

Figure 4:
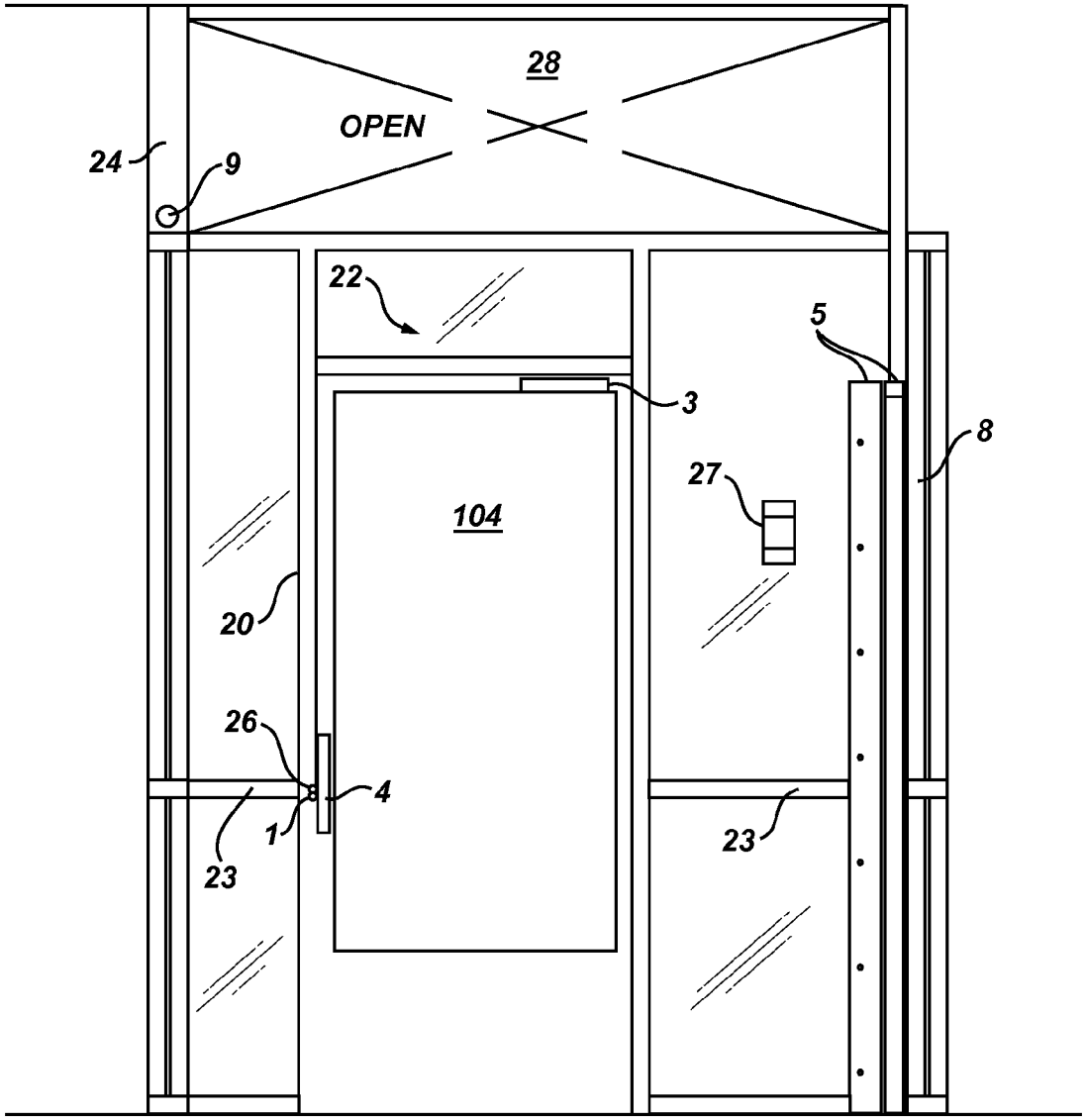
FIG. 4 is an interior elevation view of the internal door.

Referring to FIG. 4 an interior elevation view of the first interior wall is presented. This is the view experienced by a visitor standing within the safety chamber 103 and facing the interior door 104. A communication system 27 allows a person within the safety chamber to speak with an operator of the system. L shaped scanner brackets 5 may retain scanners 8. An electrified door strike 1 is powered when the interior door 104 is to remain locked. When an operator of the system wishes to allow a visitor through the interior door, the electrified door strike 1 is powered down, an LED signal light 20 is turned on or off and the visitor may push upon the fixed door handle 4 and open the interior door. A door closer 3 gently closes the interior door. A glass pane 22 is found under the open space 28 and over the interior door 104.

Figure 5:
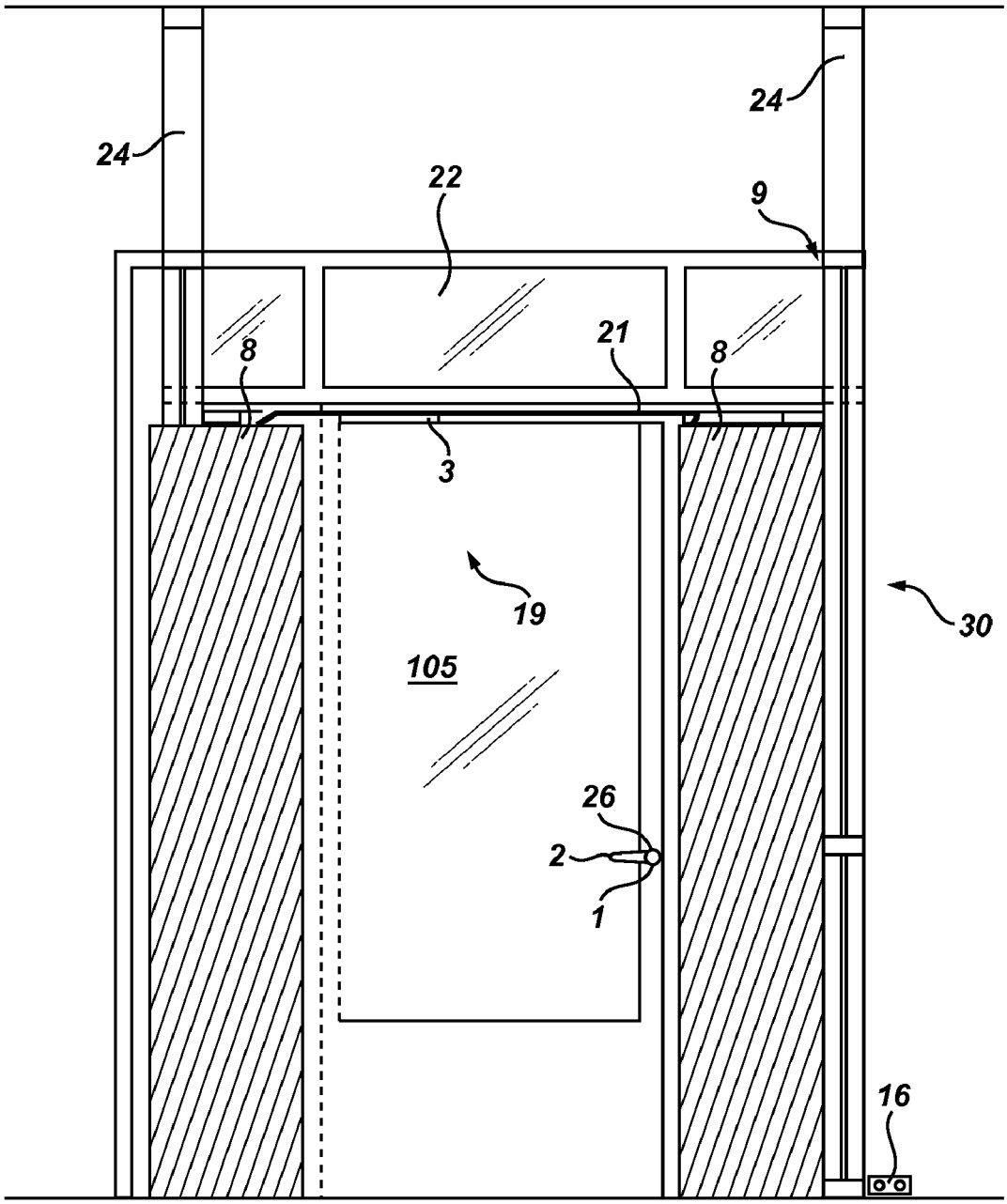
FIG. 5 is an interior elevation view of the exterior door.

Referring to FIG. 5 an interior elevation view of the exterior door 105 is presented as viewed by a person standing in the safety enclosure and looking to the outside of the building or looking toward the exterior wall 30. Scanners 8 are found on either side of the exterior door 105 and scanner connection ribbon 21 is found at the upper sections of the scanners. At any time, a person within the safety chamber may leave the building by rotating the moveable door handle 2. Visitors do not know of this means of escape and are thus less likely to bring weapons or bad intentions into the protected area. After entering the safety chamber, an electric door strike 1 is powered and prevents outsiders from entering the safety chamber. The door strike 1 mechanism is shown to be within a door mortis 26. Power outlets 16 may be found just to the outside of the first interior wall 30 and may be used to power the scanners via a wire entry point 9.

Figure 6:
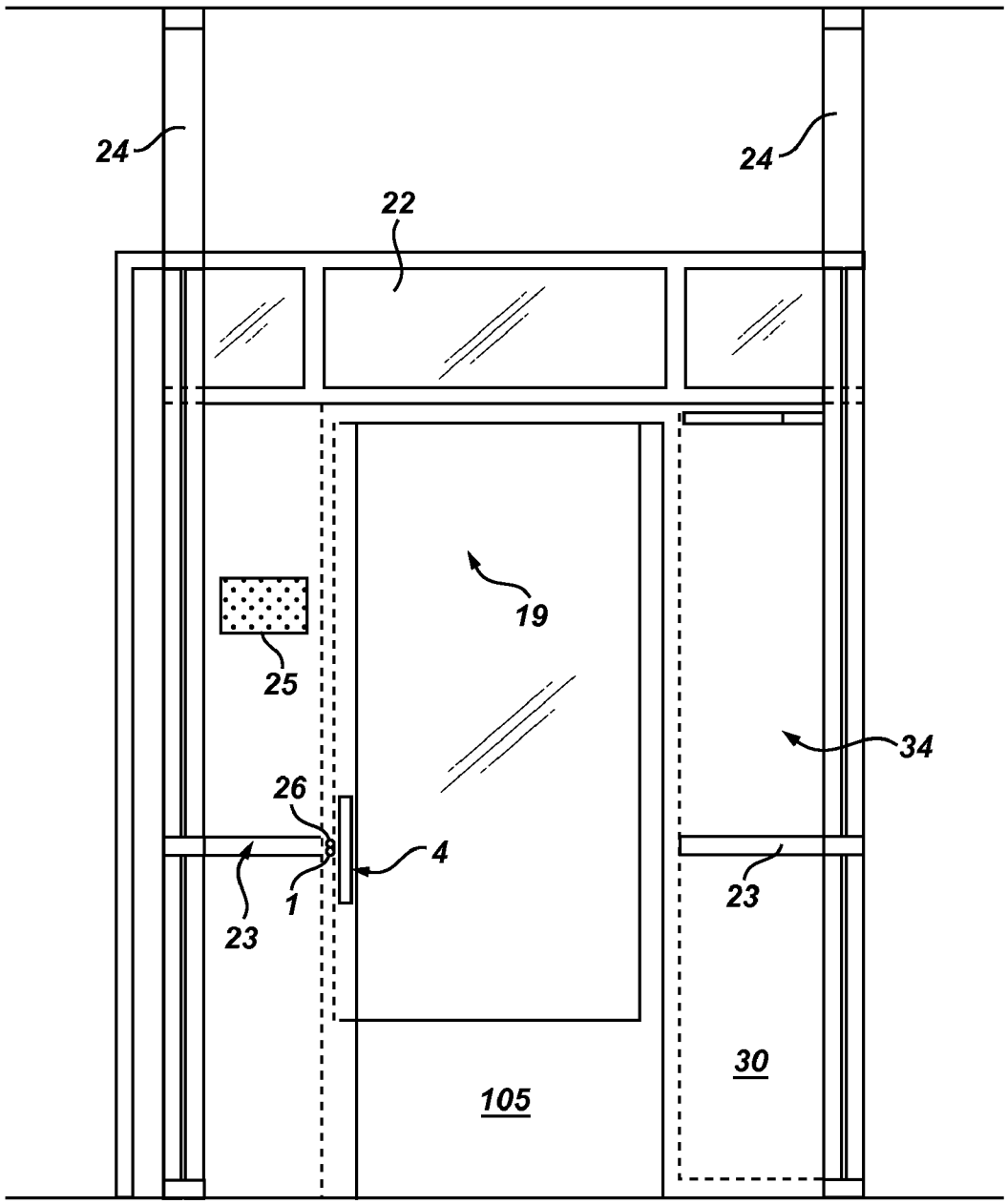
FIG. 6 is an exterior elevation view of the exterior door.

Referring to FIG. 6 an exterior elevation view of the exterior door 105 is presented from the perspective of a visitor approaching the exterior side 34 of the exterior wall 30. A sign 25 warns all visitors of the presence of scanners 8 or other means of weapons detection. Upon the potential visitor's entrance to the secured enclosure from the exterior of the building, the scanner system's relay switch activates and depowers the exterior door strike 1 locking the exterior door from the exterior and not allow anyone to enter the safety enclosure for a specific operator preprogrammed time, a visitor may push upon the fixed door handle 4 and enter the safety chamber once entry to the secured space is approved by an operator.

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

While certain aspects of the invention are presented below in certain claim forms, the inventor contemplates various aspects of the invention in any number of claim forms. Accordingly, the inventor reserves the right to add additional claims after filing the application to pursue such additional claims.

What is claimed is:

1. A system for creating an illusion of a mantrap, screening visitors and for controlling the movement of visitors, the system comprising:

a) an exterior door attached to an exterior wall of a building;

b) an interior door secured within an first interior wall;

c) the first interior wall being attached perpendicularly the exterior wall;

d) a second interior wall attached perpendicularly to the exterior wall;

e) a third interior wall in a parallel position to the exterior wall and attached perpendicularly to the first and second interior walls;

f) a safety chamber defined by an interior floor, interior ceiling, the interior door secured within the first interior wall, the second and third interior walls, the exterior wall and exterior door;

g) a protected interior space defined by the first interior wall, interior door and a structure housing the remaining protected interior space;

h) when the exterior door is in a locked state, the exterior door is operable by a person within the safety chamber and the exterior door is not operable by a person exterior to the exterior door;

i) when the interior door is in a locked state, the interior door is operable by a person within the protected interior space and the interior door is not operable by a person within the safety chamber;

j) the exterior door is attached to a door closing mechanism; when the exterior door closes, a person within the safety chamber will hear a locking sound created by a door strike and door catch assembly;

k) the exterior door having an exterior side;

l) a sign attached to the exterior side of the exterior door, with the sign warning of the presence of weapon detection equipment;

m) a communication system and microphone located within the safety chamber and attached to an interior wall, with the communication system providing means for an operator of the system to communicate with a person within the safety chamber; and n) a protocol of operation comprising:

i. placing the exterior door in an unlocked state;

ii. upon entry into the safety chamber by a first person the exterior door closes and is placed into a locked state for a predetermined amount of time;

iii. an operator of the system unlocks the interior door to allow the first person into the protected interior space, or the operator leaves the interior door in a locked state; and iv. if the predetermined amount of time expires and a second person joins the first person within the safety chamber, an operator of the system leaves the interior door in a locked state.

2. The system of claim 1 further comprising means of detecting magnetic distortions within the safety chamber and a display screen reporting measured magnetic distortions in numerical units only so as to not alarm or distract members of the public who may be viewing the display screen.

* * * * *